United States Patent [19]

Singer

[11] Patent Number: 4,586,206

[45] Date of Patent: May 6, 1986

[54] CONVERTIBLE SOFA-BED ARRANGEMENT

[76] Inventor: Morris Singer, 6257 State Ave., Kansas City, Kans. 66102

[21] Appl. No.: 171,332

[22] Filed: Jul. 23, 1980

[51] Int. Cl.[4] ..... A47C 17/06

[52] U.S. Cl. ..... 5/18 R; 5/18 B; 5/12 R

[58] Field of Search ..... 5/13, 12, 18 R, 18 B, 5/39, 37 R, 51 K, 146, 147, 76, 51 G, 86; 254/394, 272, 273; 242/155 R

[56] References Cited

U.S. PATENT DOCUMENTS

| | | | |
|---|---|---|---|
| 327,605 | 10/1885 | Shaw | 5/18 B |
| 977,529 | 12/1910 | Millert . | |
| 1,793,770 | 2/1931 | Barnes | 5/47 |
| 1,978,902 | 10/1934 | Jackson . | |
| 2,532,355 | 12/1950 | Brown | 5/18 R |
| 2,568,366 | 9/1951 | Rosen | 5/18 R |
| 2,573,997 | 11/1951 | Souza | 254/273 |
| 2,584,145 | 2/1952 | Martin . | |
| 2,640,997 | 6/1953 | Hoopingarner . | |
| 2,688,410 | 9/1954 | Nelson | 5/86 |
| 2,761,630 | 9/1956 | George | 242/155 R |
| 2,853,717 | 9/1958 | Firsel . | |
| 3,432,203 | 3/1969 | Cavalli | 5/13 |

FOREIGN PATENT DOCUMENTS 592727 2/1978 U.S.S.R. ..... 254/272

*Primary Examiner*—Thomas J. Holko
*Assistant Examiner*—Michael F. Trettel
*Attorney, Agent, or Firm*—Litman, Day and McMahon

[57] ABSTRACT

A convertible sofa-bed arrangement includes a main mounting frame in the form of a sofa and a mattress supporting frame extensible and retractable relative to the main mounting frame on track members mounted on inner portions of the main mounting frame side arms. The mattress supporting frame has opposite side frame members with front portions thereof rigid and rear portions thereof comprising pivotally interconnected link sections for curving upwardly and retracting into an elongate cavity within the sofa backrest. The mattress supporting frame is driven inwardly and outwardly of the main mounting frame by a cable and motor arrangement utilizing a plurality of gripping arms, pulleys and a winding sheave driven by the motor to draw the mattress supporting frame inwardly to a sofa position and outwardly to a bed position. A switch is connected to the motor for stopping, starting and reversing actions.

1 Claim, 6 Drawing Figures

CONVERTIBLE SOFA-BED ARRANGEMENT

This invention relates to convertible sofa-beds and particularly to sofa-beds in which a bed platform thereof slides outwardly from the sofa portion thereof.

The desirability of a convertible sofa-bed arrangement has long been known to provide sleeping arrangements for guests and for use in small apartments and the like. However, a recurring problem with such sofa-bed arrangements has been their typically bulky, heavy, and uncomfortable nature. Moreover, to fold the piece from a sofa position to a bed position has usually required such physical exertion that some people are not able to utilize the structure because of infirmities of health or age. Moreover, pinched fingers and skinned shins can become marks of a user of typical convertible sofa-bed pieces on the market today.

An additional problem with available sofa-bed arrangements is that sleeping thereon is rarely comfortable, as the mattress supporting frame thereof usually has a hinge bar extending intermediately and underneath the mattress and which is readily felt when lying thereon.

The principle objects of the present invention are: to provide a convertible sofa-bed arrangement which is as light weight as possible in order to approximate the weight of a normal sofa without a convertible bed feature; to provide such a sofa-bed arrangement which is of pleasing ornamental appearance and is comfortable for seating thereon without projecting rods, knobs, hinges and the like; to provide such a sofa-bed arrangement in which a mattress supporting frame slides generally straight inwardly and outwardly of a main mounting frame; to provide such a sofa-bed arrangement having cable means and a driving motor therewith for automatic operation; to provide such a sofa-bed arrangement having a relatively light weight cable pully and arm arrangement for drawing the mattress and its supporting frame inwardly and outwardly of the main mounting frame; to provide such a sofa-bed arrangement having a cavity in the backrest thereof so that the main mounting frame, when retracted, slides thereinto; to provide such a sofa-bed arrangement in which connecting means between the mattress supporting frame and the main mounting frame are securely guarded so that clothing, fingers and the like are not pinched thereby; and to provide such a sofa-bed arrangement which is relatively inexpensive, relatively lightweight, sturdy and efficient in use and particularly well adapted for the intended purpose.

Other objects and advantages of this invention will become apparent from the following description taken in connection with the accompanying drawings wherein is set forth, by way of illustration and example, a certain embodiment of this invention.

Figure 1:
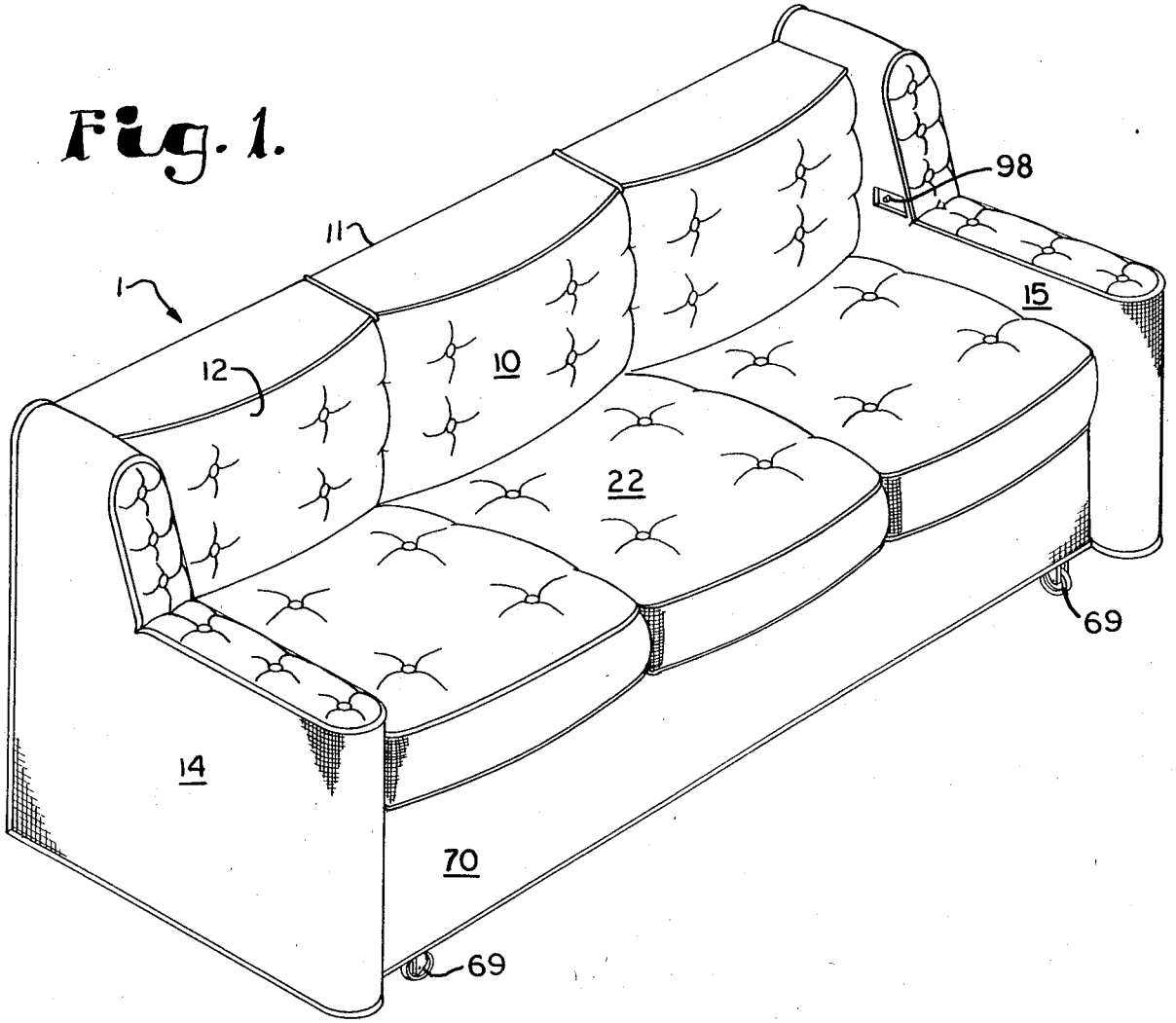
FIG. 1 is a perspective view of a convertible sofa-bed arrangement embodying the present invention and is shown with the bed portion retracted and the arrangement in a sofa position.

As required, a detailed embodiment of the present invention is disclosed herein, however, it is to be understood that the disclosed embodiment is merely exemplary of the invention which may be embodied in various forms, therefore, specific structural and functional details disclosed herein are not to be interpreted as limiting, but merely as a basis for the claims and as a representative basis for teaching one skilled in the art to variously employ the present invention in virtually any appropriately detailed structure.

Figure 2:
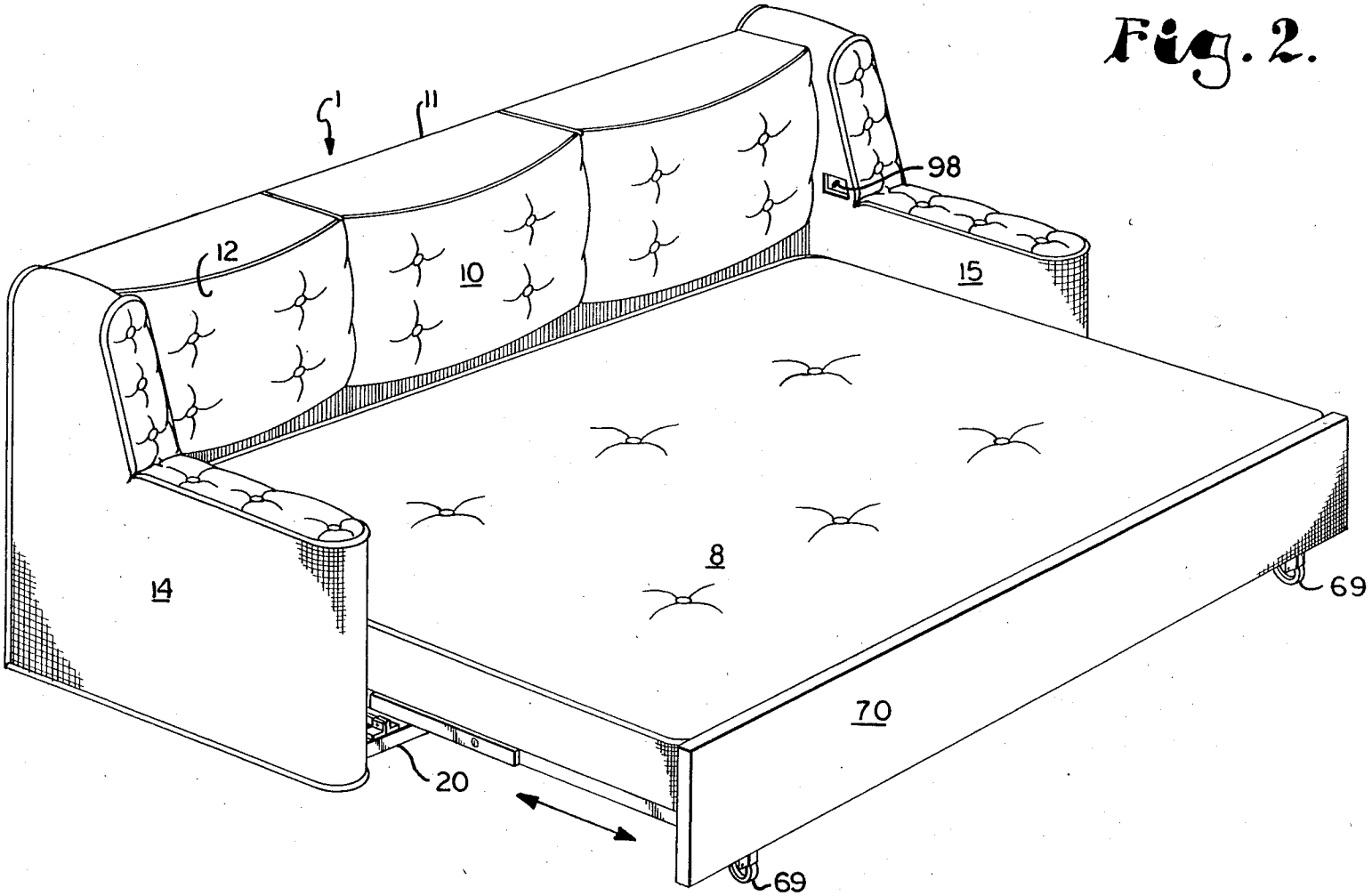
FIG. 2 is a perspective view of the convertible sofa-bed arrangement with the bed portion extended and the arrangement in a bed position.
Figure 4:
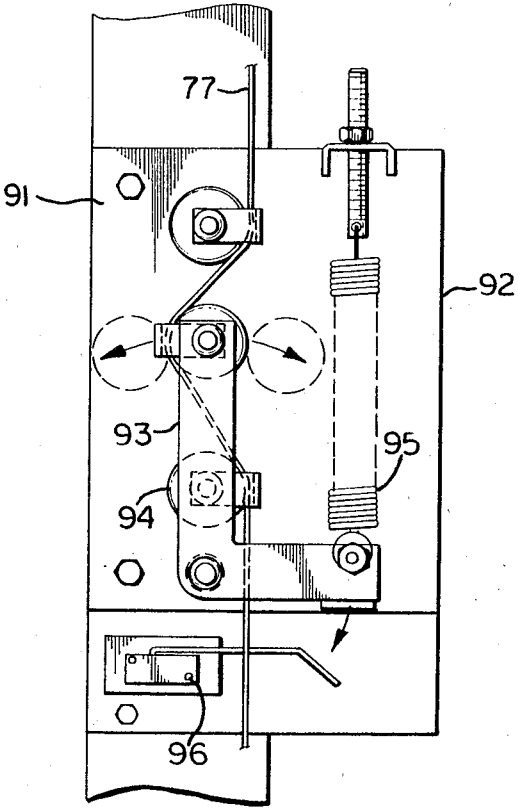
FIG. 4 is an enlarged, fragmentary view of a cable tensioner used in the sofa-bed arrangment.
Figure 3:
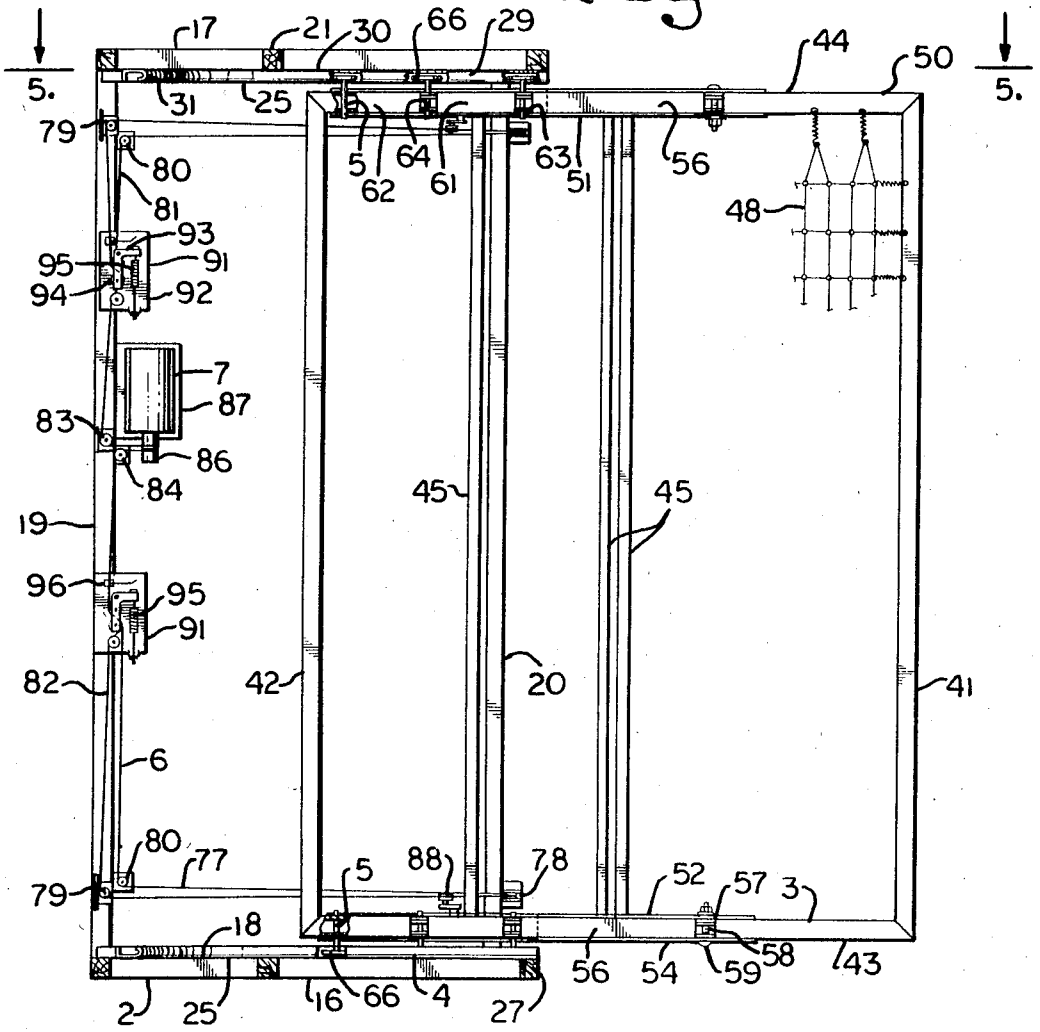
FIG. 3 is a fragmentary, plan view of the sofa-bed arrangement in a bed position and with upholstered portions omitted for purposes of clarity.
Figure 5:
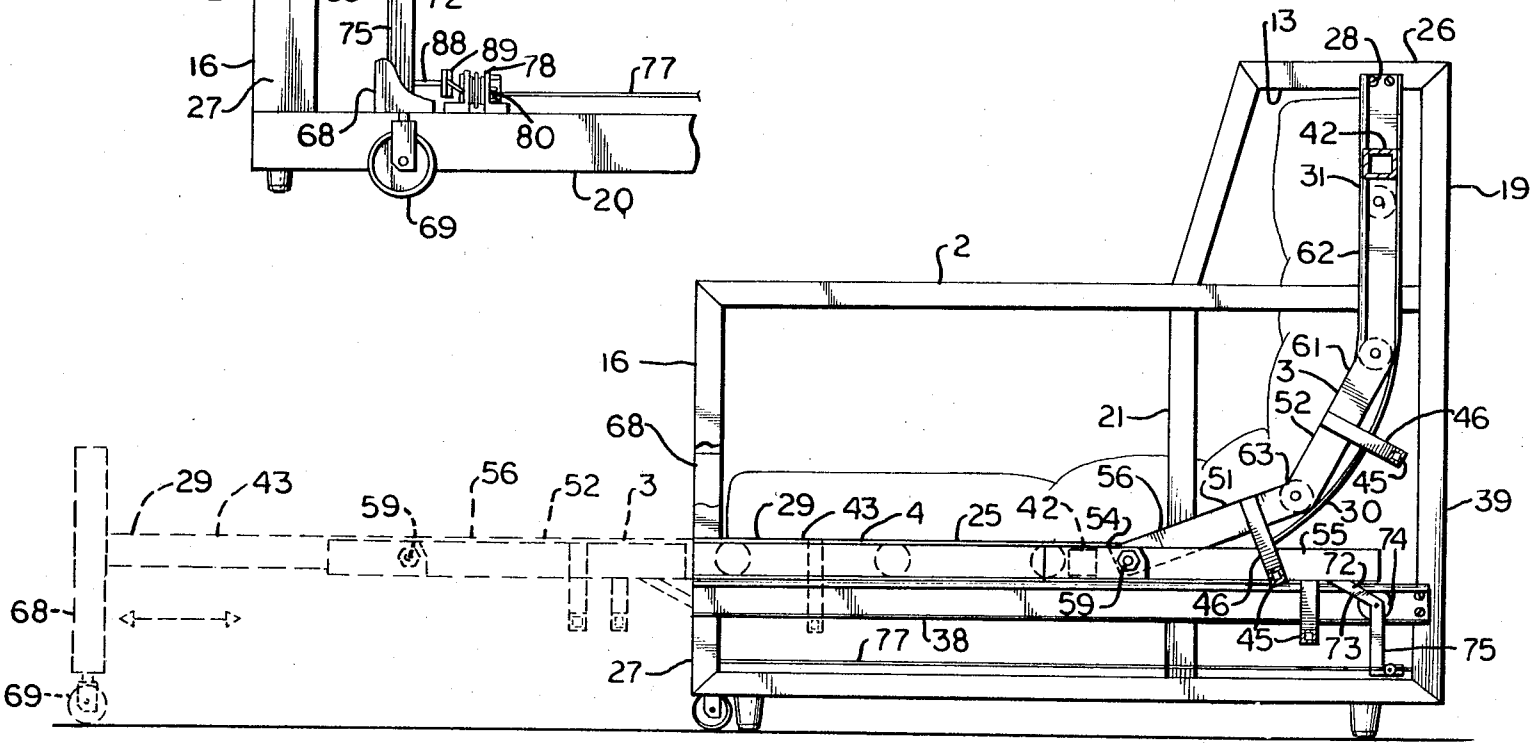
FIG. 5 is a fragmentary, end elevational view of the sofa-bed arrangement taken along lines 5—5, FIG. 3.

Referring to the drawings in more detail:

The reference numeral 1, FIGS. 1 and 2, generally indicates a convertible sofa-bed arrangement embodying the present invention and internally including, FIGS. 3 and 5, a main mounting frame 2 with a mattress supporting frame 3 slidably mounted therein. The mattress supporting frame 3 is supported by track members 4 mounted on the respective inner portions of the sofa side arms and connected to the mattress supporting frame 3. Connector means 5 extend laterally from side frame members of the mattress supporting frame 3 and are mounted on the track members 4 for supporting the frame 3 between the sofa side arms for movement between an outwardly extended bed position, FIG. 2 and a retracted sofa position, FIG. 1. A mattress 8 is positioned upon the mattress supporting frame 3 and is of a thickness and flexibility to allow for upward curving of a portion thereof in the sofa main frame 2. Movement of the mattress supporting frame relative to the main mounting frame 2 is done either manually or automatically, such as by cable means 6 arranged through a plurality of pulleys connected to arms extended from the mattress supporting frame 3 and wound about a sheave rotatably driven by a motor 7.

In the illustrated example, the main mounting frame 2 of the convertible sofa-bed arrangement 1 provides substructure for a conventional appearing sofa having an upright rear backrest 10 including a fabric covered back wall 11 upholstered to provide a plurality of front facing back cushions 12. The backrest 10 may be of slightly thicker dimension than is usual in conventional sofas to provide space for a transversely elongate cavity 13 for receipt of a rear portion of the mattress supporting frame 3 when the same is in the sofa position, FIG. 1. Opposite side arms 14 and 15 are supported by inner frame members 16 and 17 forming a rectangular, skeletal structure and have inner side portions 18. The mattress 8 is positioned so that end portions thereof are adjacent the side arms 14 and 15.

Connecting the inner frame members 16 and 17 together are backrest inner frame members 19 also forming a rectangular structure providing rigidity of the main mounting frame. A cross frame member 20 has opposite ends affixed to forward portions of the inner frame members 16 and 17 at the bottom corners thereof and extends across the front of the main mounting frame 2 in generally parallel relationship to the backrest inner frame member 19. The main mounting frame 2 includes suitable medial support members 21 providing structural rigidity and strength. The main mounting frame 2 is suitably upholstered, as by conventional means to provide upholstery on the side arms 14 and 15 and the back rest 10. The members of the main mounting frame 2 may be of lightweight metal beam construction, wood or the like, as is conventional, and secured together by welding, gluing, fasteners and the like.

A plurality of seat cushions 22, FIG. 1, are provided and placed upon the mattress 8 when the latter is in the retracted or sofa position, FIG. 1, to provide a seating surface. The seat cushions 22 are removed when the mattress supporting frame 3 is in the extended or bed position, FIG. 2, and stored in a convenient location.

Figure 6:
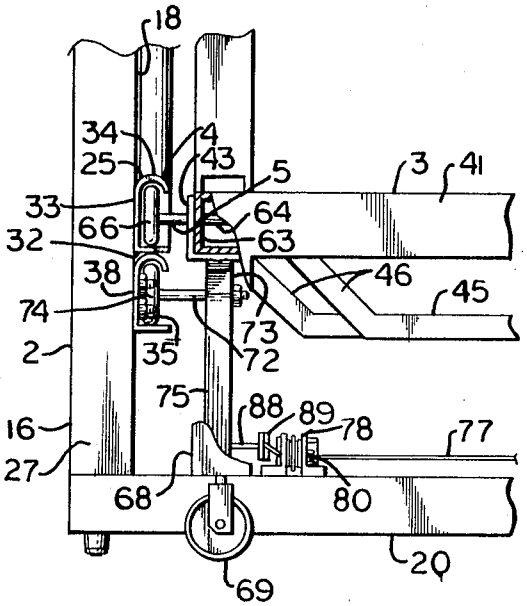
FIG. 6 is an enlarged, fragmentary view of a front corner portion of the convertible sofa-bed arrangement.

Means for slidably mounting the mattress supporting frame 3 within the main mounting frame 2 are provided and in the illustrated example, include opposite upper track members 25 extending from a top frame member 26 adjacent the cavity 13 and curving downwardly and forwardly to a forward upright frame member 27 in the interior structure of the side arms 14 and 15 and affixed thereto as by fasteners 28. The upper track members 25 have front portions 29 extended generally straight horizontally and rear portions 30 curved upwardly to form a straight, upright rear portion 31 within the cavity 13. In the illustrated example, the upper track members 25 are channular in cross-sectional shape, FIG. 6, and include a bottom generally flat ledge 32, a side wall 33 and an arcuate top wall 34.

In the illustrated example, lower track members 38 are mounted on the respective inner side portions 18 of the side arms 14 and 15 and positioned immediately below the upper track members 25. The lower track members 38 are also preferably channular in cross-sectional shape. The lower track members 38 extend generally straight and horizontally from the forward upright frame members 27 to rearward upright frame members 39.

The mattress supporting frame 3 is slidably mounted within the main mounting frame 2 and between the side arms 14 and 15 and has spaced front and rear frame members 41 and 42 and opposite side frame members 43 and 44. A plurality of cross braces 45 extend under the interior central portion of the mattress supporting frame 3 in vertically spaced relationship thereto and have upwardly angled opposite end portions 46 secured, as by welding, at respective ends to opposite side frame members 43 and 44. The cross braces 45 prevent inward bowing of the side frame members 43 and 44 under the load of a person reclining thereon.

The mattress supporting frame 3 is spanned by a spring tensioned wire fabric 48 for supporting the mattress 8.

The side frame members 43 and 44 respectively have rigid forward portions 50, such as of square tubing, and a foldable rearward portion having a plurality of pivotally interconnected link sections 52 for curving upwardly along the rear portions 30 of the upper track members 25. For a first link section 54, a channel shaped extension member 55 is secured to an end portion of the rigid forward portion 50 and provides an outer support beam section for a first link 56. The channel shaped extension 55 is secured, as by welding, to the ends of the rigid forward portions 50, FIG. 3, with the ends of the rigid forward portions 50 forming spaced ears 57 and the end of the first link 56 similarly having spaced ears 58, the ears 57 and 58 being connected by a hinge pin 59 for pivotal interconnection and upward folding of the first link section 54 with the rigid forward portion 50. The portion of the channel shaped extension member 55 extending beyond the end of the rigid forward portion 50 has one of the cross brace members 45 connected thereto and has a recess therein for connection of a second cross brace member 45 to a mid-portion of the first link 56.

Second and third links 61 and 62 similarly include respective ears 63 hinged together by pins 64. Opposite second links 61 have a cross brace member 45 extending therebetween. The third link 62 terminates adjacent the rear frame member 42 so that the rear frame member 42 is hingedly connected relative to the remainder of the mattress supporting frame 3.

A plurality of connector means 5 extend laterally from the side frame members 43 and 44 and are mounted in the opposite upper track members 25 to support the mattress supporting frame 3 between the side arms 14 and 15 on the upper track members 25 for movement between an outwardly extended bed position FIG. 2 and a retracted sofa position, FIG. 1.

In the illustrated example, there are 3 connector means for each of the side frame members 43 and 44 with each including rollers or wheels 66 respectively rotatably mounted to remote ends of the respective hinge pins 64 between the first link 56 and second link 61, the second link 61 and third link 62 and rear frame member 42. The wheels 66 roll within the channel shaped upper track member 25 and support the opposite foldable rearward portions 51 of the side frame members 43 and 44. To provide support for the front frame members 41 of the opposite rigid forward portions 50 when the mattress supporting frame 3 is extended to a bed position, front supportive legs 68 are affixed at opposite corners of the front frame member 41 and extend downwardly for contact with a floor surface. Floor engaging means such as casters 69 are affixed to ends of the legs 68 and contact the floor for travel thereon. A footboard or skirtboard 70 preferably covered in the same fabric as the upholstery of the sofa-bed arrangement 1 is affixed between the front supportive legs 68 to provide a decorative front for the sofa.

Further supporting the mattress supporting frame 3 relative to the main mounting frame 2, the opposite channel shaped extension members 55, FIG. 5, because they are rigidly mounted to the rigid forward portions 50, extend generally straight rearwardly of the forward portions 50 when the mattress supporting frame 3 is in a retracted or sofa position, FIG. 5. Lower connector means 72 extend laterally from the extension members 55 and in the illustrated example, include arms 73 having wheels 74 rotatably mounted on remote ends thereof and received within the lower track members 38. Front fasteners 35, such as nuts and bolts, mount the front ends of the respective lower track members 38 to the forward upright frame members 27 and extend into the interior channel opening thereof to provide an abuttment or stop for the wheels 74 traveling within the lower track members 38. Arm sections 75 extend downwardly from the connection of the wheels 74 with the arms 73 for a purpose later described.

The mattress supporting frame 3 can be manually moved from an extended position to a retracted position by grasping the front frame member 41 and pulling or pushing thereon as desired. Alternatively, and in the illustrated example, power means are disclosed for providing automatic movement of the mattress supporting frame 3 and include the cable means 6 operably connected between the mattress supporting frame 3 and the main mounting frame 2 and driven by the motor 7.

In the illustrated example, the cable means 6 includes an endless flexible tensile member such as a cable 77 which travels along the bottom beam of the backrest inner frame members 19 and forwardly along the inner portions of the frame members 16 and 17 of the side arms 14 and 15, FIG. 3. The exemplary cable 77 is endless and is used for both extension and retraction through a system of pulleys. The foremost position of the cable 77 is around spaced opposite front pulleys 78 mounted for rotation in a vertical plane. Positioned adjacent opposite corners of the juncture of the backrest inner frame members 19 with the respective side arm inner frame members 16 and 17 are pairs of pulleys 79 and 80 mounted for rotation in a horizontal plane and around which extension and retraction portions of the cable 77 travel. Return cable portions 81 and 82 have ends thereof joined together (not shown) to provide the endless cable 77. Other portions of the cable 77 extend around pulleys 83 and 84 and are wound on a sheave 86 driven by the motor 7. The motor 7 is positioned on a mounting plate 87 affixed to bottom beams of the backrest inner frame members 19 and positioned so that the sheave 86 is substantially equidistant from the side arm inner frame members 16 and 17.

To provide a point of connection of the cable 77 to the mattress supporting frame, gripping means are included on the opposite arm sections 75 and in the illustrated example, respectively include a pin 88 extended inwardly and laterally from the end of the arm sections 75 and with clamp members 89 such as discs gripping the cable 77 therebetween sufficiently tightly so that the arm sections 75 are drawn with the cable 77 toward and away from the front pulleys 78 in response to power rotation of the sheave 86, thereby pulling the mattress supporting frame 3 therewith for extension and retraction relative to the main mounting frame 2.

In the illustrated example, cable tensioners 91 are provided and include a mounting plate 92 having an L-shaped arm 93 swingably mounted thereon and with a plurality of pulleys 94 around which the cable 77 is wound. Spring means 95 maintains tension on the L-shaped arm 93 and a safety switch 96 to stop operation of the motor 7 is affixed adjacent the arm 93 for contact therewith to activate the switch when tension greater than the force of the spring 95 is sensed upon the cable 77, such as by an object or person blocking full extension of the mattress supporting frame 3. The safety switch 96 thereby protects against damage to such object or person.

A switch control means 98 is situated in one of the side arms 14 or 15 and is of the type for controlling starting, stopping and reversing of the motor 7.

The operation of this improved sofa-bed arrangement is quite simple for the user and consists of actuating the switch control means 98 to the desired position, either bed or sofa whereupon the motor 7 is energized and drives the sheave 86 to pull the cable 77 one way or the other. If the sofa-bed arrangement 1 is in a bed position and "sofa" is selected, the motor pulls upon the cable 77 from the pulleys 79 to the gripping clamp members 89 to draw the mattress supporting frame 3 theretoward. Because the gripping clamp members 89 are positioned intermediately of the side frame members 43 and 44, there is sufficient cable travel to pull the foldable rearward portions 51 upwardly and into the cavity 13 for storage of a portion of the mattress supporting frame 3 and a side portion of the mattress 8 therein.

If the sofa-bed arrangement 1 is in a sofa position and "bed" is selected, the motor 7 draws the cable 77 in the reverse direction from the foregoing situation and pulls the gripping clamp members 89 secured to the cable 77 toward the front pulleys 78. Similarly, because the gripping disc members 89 are positioned intermediately of the side frame members 43 and 44, the rigid forward portions 50 thereof extend fully outwardly from the main mounting frame 2 before full cable travel toward the front pulleys 78 is achieved.

As the mattress supporting frame 3 is drawn outwardly of the main mounting frame 2 by the cable 77, the opposite first links 56 are positioned adjacent the side arm forward upright frame members 27 when the mattress supporting frame fully extends into the bed position. The opposite first links 56 retract toward the opposite rearward upright frame members 39 as the mattress supporting frame 3 retracts so that the respective remote ends of the opposite extension members 55 become positioned adjacent the rearward upright frame members 39.

Should an obstacle be encountered to movement of the mattress supporting frame 3 relative to the main mounting frame 2 or if the switch control means 98 is actuated incorrectly, such as to "sofa" when the sofa-bed arrangement 1 is already in a sofa position, the cable tensioners 91 react to the undue tension placed on the cable 77 to actuate the safety switch 96 and stop the motor 7.

When the sofa-bed arrangement 1 is in the "bed" position, persons thereon recline between the opposite side arms 14 and 15. Rest is comfortable thereon because there are no central cross bars or the like which contact the bottom of the mattress 8 and act as hard places to dig into the ribs or backs of persons thereon.

It is to be understood that while one form of this invention has been illustrated and described, it is not to be limited to the specific form or arrangement of parts herein described and shown, except insofar as such limitations are included in the following claims.

What is claimed and desired to be secured by Letters Patent is:

1. A convertible sofa-bed arrangement comprising:

(a) a main mounting sofa frame having an upright backrest with a traversely elongated cavity therein and having opposite ends;

(b) track members mounted at said opposite ends of said sofa frame, each track member having a front portion extending generally horizontally and a rear portion curving upwardly from said front portion and into said cavity;

(c) a mattress supporting frame slidably connected at opposite sides thereof to said track members, said mattress frame assuming a bed position upon being fully extended along said track members toward said front portions thereof and assuming a sofa position upon being fully retracted along said track member toward said rear portions thereof, said mattress frame having a front end adjacent said front portions of said track members in said sofa position;

(d) floor engaging casters on said front end of said mattress frame to support same in said bed position;

(e) a mattress positioned on said mattress frame, said mattress having a head end, a foot end, and opposite sides;

(f) said mattress being a substantially standard full size sofa-bed mattress;

(g) said sofa frame and said mattress frame being sized and shaped to receive said mattress in an orientation wherein said head end and said foot end of said mattress are positioned respectively adjacent said opposite sides of said mattress frame and such that side portion of said mattress is received in said cavity in said sofa position;

(h) reversible motor means positioned on said sofa frame, operatively connected to said mattress frame, and operable to translate said mattress frame with said mattress thereon substantially completely between said bed position and said sofa position;

(i) said motor means includes a rotary shaft;

(j) a sheave is positioned on said shaft;

(k) pulley means are mounted on said sofa frame;

(l) cable means engages said sheave and said pulley means and is connected to said mattress frame whereby rotation of said shaft is operative to effect translation of said mattress frame between said bed and sofa positions;

(m) said sofa frame has a front portion and a rear portion;

(n) said pulley means includes a first pulley and a second pulley mounted respectively at said front and rear portions of said sofa frame;

(o) said cable means includes a cable, said cable extending between said first and second pulleys;

(p) said cable is connected to said mattress frame at a point on said cable between said first and second pulleys;

(q) said motor means is an electric motor;

(r) safety switch means is electrically connected to said motor and mechanically connected to said cable and is operative to stop the operation of said motor in response to a selected increase in the tension of said cable;

(s) said safety switch means includes a pair of spaced apart rollers mounted on said sofa frame and having said cable engaged therewith;

(t) a lever arm pivotally mounted on said sofa frame, said arm having a sensing roller at one end thereof, said sensing roller engaging said cable at a position between said pair of rollers;

(u) spring means connected to said arm at an end opposite said sensing roller and connected to said sofa frame, said spring means biasing said sensing roller into engagement with said cable against the tension of said cable;

(v) a switch contact member on said lever arm at a position spaced from the pivotal connection of said arm to said sofa frame; and (w) a switch positioned on said sofa frame and including a switch operator for contact by said switch contact member upon the tension of said cable exceeding the force of said spring, said switch being connected to said motor and operative to stop the operation thereof upon contact of said switch operator by said switch contact member.

* * * * *